US005148846A

United States Patent [19]

Van Gelder

[11] Patent Number: 5,148,846

[45] Date of Patent: Sep. 22, 1992

[54] WORKPIECE GUIDE

[76] Inventor: Harry Van Gelder, 15200 Stagg St., #3, Van Nuys, Calif. 91405

[21] Appl. No.: 829,226

[22] Filed: Feb. 3, 1992

[51] Int. Cl.[5] ..... B27B 5/06; B27B 27/02; B27C 1/12

[52] U.S. Cl. ..... 144/249 R; 83/447; 83/450; 144/242 C; 144/253 D

[58] Field of Search ..... 144/242 A, 242 C, 247, 144/249 R, 253 R, 253 D, 253 F; 83/438, 446, 447, 450

[56] References Cited

U.S. PATENT DOCUMENTS

| | | | |
|---|---|---|---|
| 3,738,403 | 6/1973 | Schwoch et al. | 83/446 |
| 4,469,318 | 9/1984 | Slavic | 83/447 |
| 4,976,298 | 12/1990 | Gibson | 83/446 |
| 5,058,474 | 10/1991 | Herrera | 83/450 |

*Primary Examiner*—W. Donald Bray

[57] ABSTRACT

A workpiece guide to help feed boards into a woodworking machine such as a power saw. The guide is adapted to hold the board against the guide fence as the board is fed into the saw by pressing a knurled wheel down against the board. The wheel is slightly angled to move the board toward the fence and is pressed down against the board by a leaf spring thus keeping the board from riding up on the blade.

5 Claims, 1 Drawing Sheet

WORKPIECE GUIDE

BACKGROUND AND SUMMARY OF THE INVENTION

This invention pertains to safety means for woodworking power tools, and more particularly to a device to hold a workpiece against the guide fence of such a tool as the workpiece is moved past a rotating cutter.

Woodworking power tools are notably dangerous, principally because cutting tools for wood cut at relatively high speeds and are thus apt to cut operator's misplaced hands quickly. Power saws, shapers, routers and the like are particularly difficult to guard because the operator typically uses a hand to feed the workpiece past the cutter. The object of almost any safety device for such tools must be to keep the operator's hands at a safe distance from the cutter.

In order to rip-cut wood properly on a power saw the piece being cut must be held firmly against the guide fence as the piece passes the saw. The piece must also be fed through the saw. My co-pending application, Ser. No. 718,578, filed Jun. 20, 1991 proposes a safe feeding mechanism. The purpose of the present device is to hold the workpiece against the fence. Although it is described in conjunction with a power saw, it will be obvious that a similar problem exists in a shaper or router where a workpiece is also longitudinally moved past a rotating cutter although the axis of rotation may be vertical rather than horizontal. In such a machine, the same danger is present, and a device embodying the present invention may also be useful.

DESCRIPTION

Figure 1:
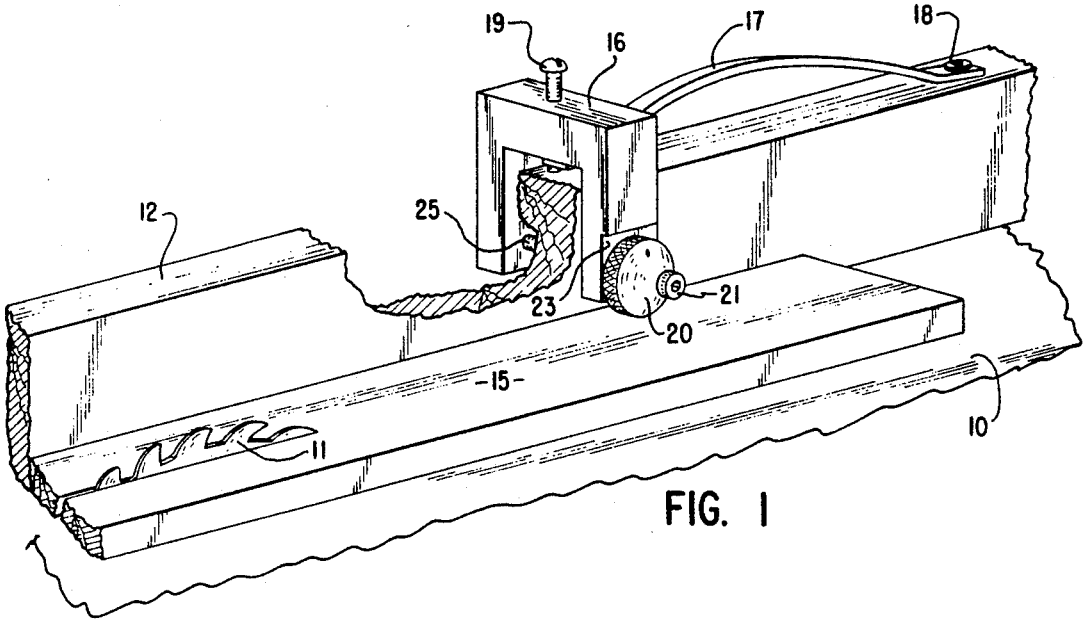
FIG. 1 is a perspective view of a woodworking table saw with the feeder device in place on the guide fence.
Figure 2:
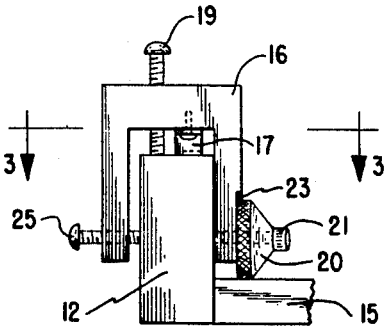
FIG. 2 is an end view of the fence showing the feeder in place.

Briefly my invention comprises a safe-feeding device for a power driven woodworking machine using an angled, knurled wheel to hold a wood workpiece against a guide fence on such a machine.

More particularly, and referring to the drawings, the device is designed for use on any of several different types of woodworking tools. However, it will be described in connection with an ordinary table saw because that particular tool is a very familiar type of application.

A table saw includes a table 10 on which is mounted a motor (not shown) driving a rotating saw blade 11. A guide fence 12 would normally be movably fixed to the table so that the space between it and the saw blade could be varied to cut a variety of board widths. In use, the board or workpiece 15 is slidably fed past the blade 11 and over the surface of the table 10 while being held laterally against the fence 12.

The present invention is directed toward the latter function. To that end, a yoke-shaped carrier 16 is provided astraddle the fence 12. This yoke 16 is held in a longitudinal position relative to the fence by an arched leaf spring 17 having one end fixed to the cross member of the yoke and the other end fixed to the fence by a screw 18 or the like. The spring 17 is long enough to allow considerable vertical movement of the yoke 16 and may be arched to provide relatively constant pressure so that various thicknesses of workpieces 15 may be accommodated. An adjustment screw 19 may be used to adjust different thicknesses of workpiece while preserving downward pressure on the workpiece 15.

Figure 3:
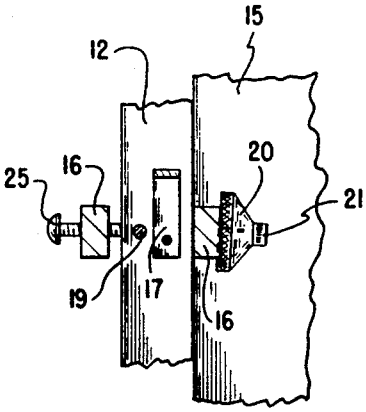
FIG. 3 is a view from line 3—3 of FIG. 2.

On one leg of the yoke 16, a knurled wheel 20 is rotatably mounted on an axle 21 which may be in the form of a screw threaded into the material of the yoke. This wheel is free to rotate on the axle. However, as best shown in FIG. 3, the axis about which the wheel rotates is not perpendicular to the surface of the fence 12, but is at a slight angle from the perpendicular. The plane of rotation of the wheel is thus angled slightly so as to pull the workpiece 15 towards the fence 12. The yoke 16 may be slightly notched as at 23 to accommodate the angled alignment.

On the leg of the yoke 16 opposite the wheel 20, I provide adjustment and holding means to provide for use of the device on fences which may be of different thicknesses. The illustrated device is simply a nylon screw 25 threaded through the yoke so that it can slide on the outer side of the guide fence 12. The screw 25 should not press tightly against the fence, but rather should allow vertical sliding of the yoke 16 so that the leaf spring 17 will perform its function of holding the wheel 20 firmly against the workpiece 15. A nylon screw is indicated so that the yoke will slide without binding or scratching the fence.

Although the slide 25 is shown as a simple screw, it will be obvious that some sort of added slide device at the end of the screw adjacent the fence may be desirable to preserve the sliding ability. This may be some simple broader cup device on the end of the screw 25 adapted to slide against the fence, or may be a more elaborate device—particularly for use with a metal fence where the outer surface is not flat. Such variations should be well within the ability of one skilled in the art.

In use, the device must first be fixed to the top of the fence 12 by the screw 18 through the spring 17. The yoke must be astraddle of the fence 12 with the wheel 20 on the same side of the fence as the saw blade 11. The axle 21 of the wheel 20 will then be angled so that a board 15 will tend to be pulled toward the fence as it is pushed (usually), or pulled by a device such as that described in my previously noted copending application, past the blade 11. The adjustable sliding device illustrated as the screw 25 should be adjusted to provide for easy vertical movement of the yoke, but for little or no lateral movement. The screw 19 is also adjusted for the thickness of the workpiece 15.

As the board or workpiece 15 is now moved first under the wheel 20, that wheel will be pushed upward against the bias of the spring 17. As the workpiece moves toward and past the blade 11, it will be urged toward the fence 12 by the angled wheel with its knurled outer surface. Thus, the workpiece will tend to be held against the fence as the workpiece is cut, as desired.

I claim:

1. For use with a power woodworking tool having a table, a guide fence adjustably fixed to said table and cutter means extending above said table adjacent said guide fence, feed assisting guide means comprising a yoke mounted astraddle of said fence, and movable vertically relative thereto, wheel means pivotally fixed on one leg of said yoke and on the same side of said fence as said cutter means, said wheel having an axis of rotation tilted from a perpendicular to said fence, and means to bias said wheel towards said table whereby a workpiece on said table will be held against said fence.

2. The feed assisting guide means of claim 1 in which said means to bias said wheel means comprises a spring means attached to said yoke and said fence.

3. The feed assisting guide means of claim 4 in which said spring means includes a leaf spring having one end attached to said yoke and a second end fixed to said fence.

4. The feed assisting guide means of claim 1 in which said yoke has two legs, said wheel means being rotatably mounted on one leg, adjustable slide means mounted on the second of said legs, said slide means being adapted to engage said fence to allow vertical movement of said yoke and to prevent movement of said yoke laterally of said fence.

5. The feed assisting guide means of claim 4 in which said slide means is adjusted by a screw threaded through said second of the legs.

* * * * *